United States Patent [19]

Klett

[11] Patent Number: 4,601,119

[45] Date of Patent: Jul. 22, 1986

[54] CORNER TOOTH FOR A BUCKET

[75] Inventor: Gene R. Klett, Washington, Ill.

[73] Assignee: Caterpillar Tractor Co., Peoria, Ill.

[21] Appl. No.: 656,622

[22] Filed: Oct. 1, 1984

[51] Int. Cl.[4] ..... E02F 9/28

[52] U.S. Cl. ..... 37/141 T; 37/142 R; 172/704; 172/777

[58] Field of Search ..... 37/141 R, 141 T, 142 R, 37/142 A; 172/701.2, 703, 704, 713, 777, 778

[56] References Cited

U.S. PATENT DOCUMENTS

| | | | |
|---|---|---|---|
| 3,326,302 | 6/1967 | Washbond et al. | 37/142 R X |
| 3,440,745 | 4/1969 | Palm | 37/141 R |
| 3,805,422 | 4/1974 | Stepe | 37/141 R |
| 3,967,398 | 7/1976 | Stepe | 37/141 R |
| 4,136,469 | 1/1979 | Zepf | 34/141 T |

FOREIGN PATENT DOCUMENTS

| | | | |
|---|---|---|---|
| 2435562 | 5/1980 | France | 37/141 R |

*Primary Examiner*—Edgar S. Burr
*Assistant Examiner*—Moshe I. Cohen
*Attorney, Agent, or Firm*—J. W. Burrows

[57] ABSTRACT

A corner tooth is useful, for example, on construction equipment buckets to protect the sidewalls from abrasive wear which normally results from continued contact with the ground. In order to protect the sidewall, others use elements secured directly to the sidewall or various forms of specialized teeth mounted on the corner. Many of these specialized teeth inhibit the tooth's ability to penetrate the ground. The present corner tooth provides the protection for the sidewall while still maintaining good strength and penetration. This is due to a single flat member being oriented vertically with respect to the normal working position of the tooth and a single reinforcement rib extending perpendicular to the flat member. Furthermore, since the tooth is symmetrical about the second plane and the rib is located along the second plane the tooth can be used on either corner. This eliminates the need to manufacture and stock an extra part of a different design. Furthermore, once the part is installed, it remains in the same location for its entire useful life thus eliminating down time to change the tooth from one corner to the other.

17 Claims, 4 Drawing Figures

CORNER TOOTH FOR A BUCKET

TECHNICAL FIELD

This invention relates generally to a tooth for a bucket and more particularly to a tooth secured to the corner of the bucket to protect the sidewall member from excessive wear and to aid bucket penetration of the ground.

BACKGROUND ART

The sidewall members of a bucket, especially an excavator bucket, wear excessively due to continuous scrubbing contact with the ground during digging operations. Some use special side cutters connected to the sidewall to help overcome this problem. Even though these special cutters help, they add additional costs in the form of materials and manufacturing operations. Others have used various forms of teeth secured to the front corner of the bucket. Even though these help protect the sidewall and aid in the ability of the bucket to work in hard ground, they also hamper penetration due to their design. One form of these has two ground engaging points that requires moving the tooth from one corner to the other to obtain the best total wear life. This form of tooth requires down time for changing the tooth from one corner to the other and inhibits penetration due to the extra point that has to penetrate the ground. Another form of tooth is made to fit only on one corner of the bucket. Consequently, it is necessary to manufacture and stock two different styles for repair or replacement.

The present invention is directed to overcoming one or more of the problems as set forth above.

DISCLOSURE OF THE INVENTION

In one aspect of the present invention, an earth working tooth is provided for attachment to the leading edge of a bucket. The tooth includes an attachment portion adapted for engagement with the bucket to maintain the tooth in a normal working position. A first plane is defined in the tooth along the central longitudinal axis of the attachment portion. The first plane is vertically oriented with respect to the normal working position of the tooth. A second plane is defined in the tooth along the central axis of the attachment portion perpendicular to the first plane. The tooth also includes a ground engaging portion having a single substantially flat member spaced from the first plane and connected to and extending from the attachment portion and a single reinforcement rib extending perpendicularly from the flat member and being connected to both the flat member and the attachment portion. The tooth is symmetrical about the second plane so that the tooth may be attached to either end of the leading edge of the bucket.

The present invention provides a tooth that protects the sidewall of the bucket and remains "sharp" as the tooth wears to maintain its ability to penetrate the ground more easily. The tooth of the present invention is interchangeable from corner to corner thus eliminating the manufacturing and stocking of two different forms of teeth to protect the two sidewalls of the bucket.

BEST MODE FOR CARRYING OUT THE INVENTION

Figure 1:
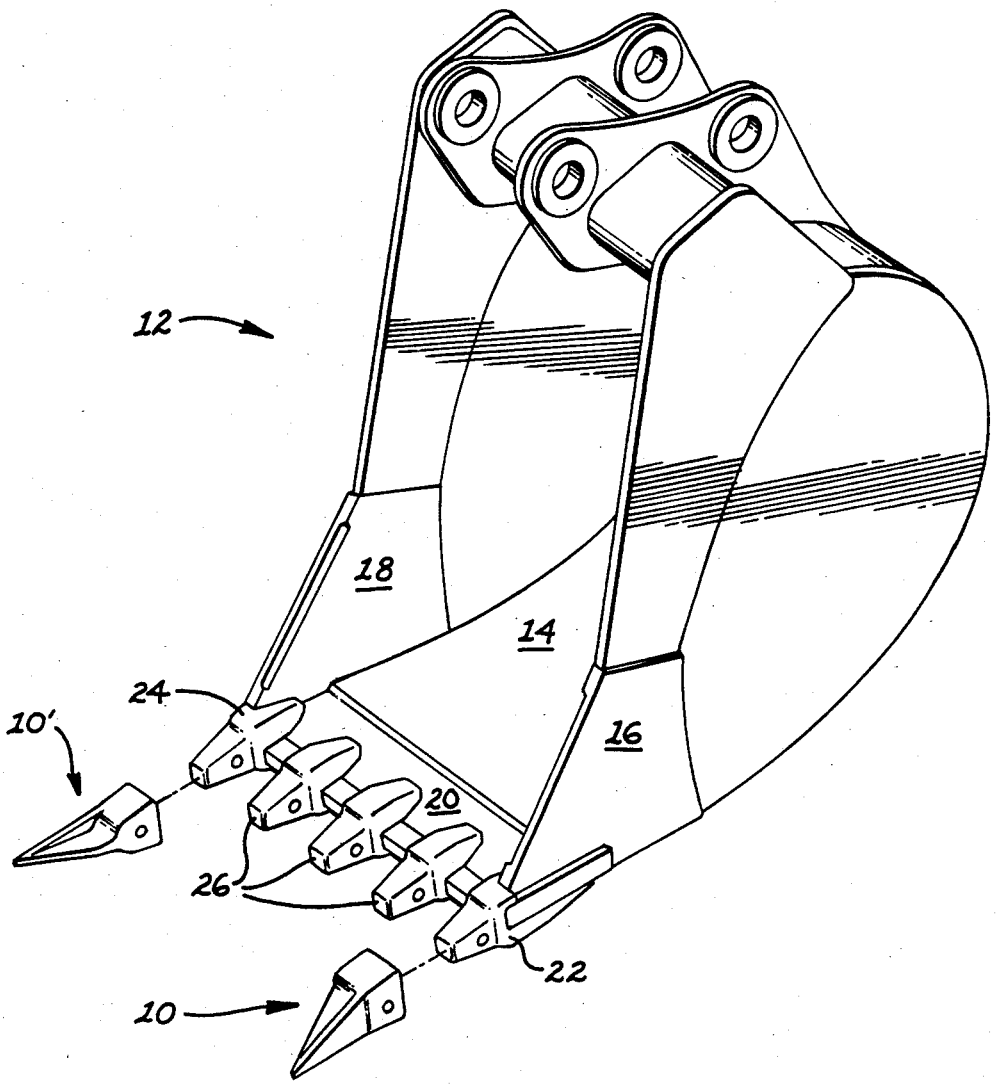
FIG. 1 shows a bucket having a tooth illustrating an embodiment of the present invention.

Referring now to the drawings, and particularly to FIG. 1, an earth working tooth 10 is shown for use on the corner of a bucket 12. Another tooth 10' is shown on the opposite corner. Since both teeth are identical, only one will be described in detail.

The bucket 12 has a body portion 14, first and second sidewall members 16,18, a leading edge 20 secured to the body portion 14 and to the first and second sidewall members 16,18. First and second tooth adapters 22,24 are secured to the leading edge at opposite ends thereof and a plurality of center teeth adapters 26 are secured to the leading edge 20 spaced between the first and second tooth adapters 22,24. It is recognized that any number of center tooth adapters 26 may be used depending on the width of the bucket 12. In use, the plurality of center teeth adapters would have teeth mounted thereon.

Figure 2:
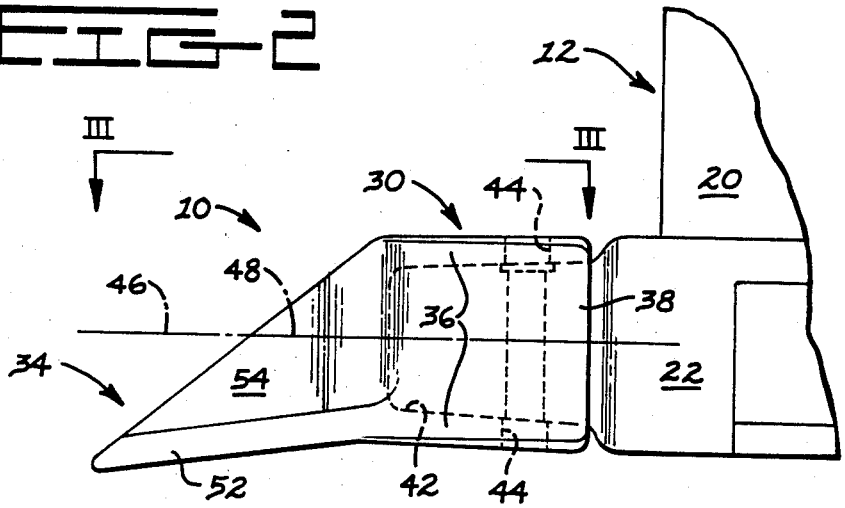
FIG. 2 illustrates a top view of the tooth and its connection to the bucket.
Figure 3:
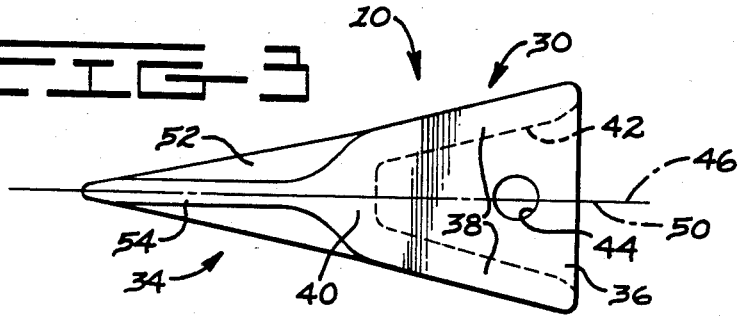
FIG. 3 illustrates a side view of the tooth.

The tooth 10, as more clearly shown in FIGS. 2 and 3, includes an attachment portion 30 and a ground engaging portion 34. The attachment portion 30 has first and second pairs of laterally spaced side portions 36,38 connected at one end by an end portion 40. A socket 42 is defined by the side portions 36,38 and the end portion 40. The socket 42 is adapted to engage the adapter 22 and maintain the tooth in a normal working position with respect to the ground. A hole 44 is defined in the first pair of laterally spaced side members 36 and opens into the socket 42.

The first pair of laterally spaced side portions 36 are generally parallel to each other. Due to casting or forging requirements, a normal draft angle of 3 to 5 degrees on each side is permitted. The second pair of laterally spaced side portions 38 slope inwardly to form an acute angle ranging from approximately 25–35 degrees. Consequently, the width of the first pair of side portions 36 is narrower at the intersection with the end portion 40.

A central axis 46 is defined in the tooth 10 longitudinally through the center of the socket 42. A first plane 48 is defined along the central axis 46 and is vertically oriented with respect to the normal working position of the tooth 10. A second plane 50 is defined along the central axis 46 in the tooth 10 and perpendicular to the first plane 48.

The ground engaging portion 34 has a single substantially flat member 52 connected to one of the first pair of laterally spaced side portions 36 and a single reinforcement rib 54 centrally disposed along the second plane 50 and connected to both the flat member 52 and the end portion 40. The flat member 52, as clearly shown in FIG. 2, is not parallel to the longitudinal axis 46 but is generally perpendicular to the second plane 50. Furthermore, the flat member 52 is spaced from the first plane 48 and is closest to the first plane 48 at the point of intersection with the one laterally spaced side 36. The width of the flat member 52 is substantially the same as the width of the one side portion at the point of intersection with the one side portion and progressively tapers to a narrow width at the other end less than one-third the width of the one side portion. Preferably the width at the other end is less than the thickness of the reinforcement rib 54.

The reinforcement rib 54 is generally triangular in shape having the longest side extending from the other side portion 36 and ending adjacent the narrow end of the flat member 52.

Figure 4:
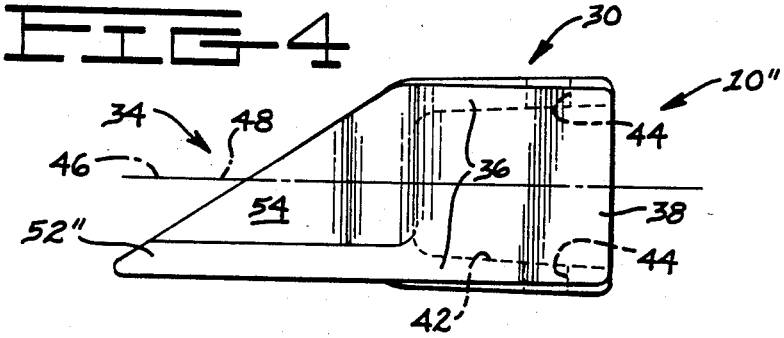
FIG. 4 illustrates another embodiment of the tooth.

FIG. 4 illustrates another embodiment of the present invention. The tooth 10'' is the same as the aforementioned tooth 10 with the exception that the flat member 52'' of tooth 10'' is parallel with the first plane 48.

INDUSTRIAL APPLICABILITY

During operation of the bucket 12 with the tooth 10 attached to the first corner tooth adapter 22 and the other tooth 10' attached to the second corner adapter 24, the flat members 52 of the respective teeth 10,10' penetrates the earth and cuts the side wall of the trench thus greatly reducing contact of the first sidewall 16 with the side of the trench. The narrow width of the flat member 52 at the leading end enhances the ability of the tooth 10 to penetrate the earth while the reinforcement rib 54 adds strength to the tooth without adversely affecting its ability to penetrate. It should be recognized that the tooth 10'' can be used on the bucket 12 in place of the tooth 10 or 10'.

Since the tooth 10/10'' is symmetrical along the second plane 50, the tooth 10/10'' can be used on either corner simply by turning it 180° about the central axis 46 and mounting it on the second corner tooth adapter 24.

The earth working tooth 10/10'' set forth above provides protection of the side wall member 16/18 and high strength while having good penetration ability as wears. Due to the symmetry of the tooth, it is used on either corner thus eliminating the need to manufacture and stock more than one part number.

Other aspects, objects and advantages of this invention can be obtained from a study of the drawings, the disclosure and the appended claims.

I claim:

1. An earth working tooth adapted for attachment to either end of the leading edge of a bucket, comprising:

an attachment portion adapted for engagement with the bucket to maintain the tooth in a normal working position;

a first plane defined in said tooth along a central longitudinal axis of the attachment portion, said plane being vertically oriented with respect to the normal working position of the tooth;

a ground engaging portion having one and only one substantially flat member spaced from and vertically oriented with the first plane and connected to and extending from the attachment portion and a single reinforcement rib extending perpendicularly from the flat member and being connected to both the flat member and the attachment portion; and a second plane defined in said tooth along the central axis perpendicular to the first plane, said reinforcement rib being centrally disposed along said second plane and said tooth being symmetrical about the second plane, a cross section of said tooth through said reinforcement rib and normal to said flat member being T-shaped.

2. The tooth, as set forth in claim 1, wherein the reinforcement rib is generally triangular in shape with the longest side extending from the attachment portion opposite to the connection of the flat member with the attachment portion to the end of the flat member opposite the end that connects with the attachment portion.

3. The tooth, as set forth in claim 2, wherein the flat member tapers in width from a larger width at the point of connection with the attachment portion to a smaller width at the other end of the flat member.

4. The tooth, as set forth in claim 3, wherein the width of the flat member at the other end is no greater than the thickness of the reinforcement rib.

5. The tooth, as set forth in claim 4, wherein the flat member is non-parallel with the first plane and is closest to the first plane at the intersection with the attachment portion.

6. An earth working tooth adapted for attachment to either end of the leading edge of a bucket, comprising:

an attachment portion having first and second pairs of laterally spaced side portions connected by an end portion to define a socket, said socket being adapted for engagement with the bucket to maintain the tooth in a normal working position;

a first plane defined in said tooth along a central longitudinal axis of said socket, said plane being vertically oriented with respect to the normal working position of the tooth;

a second plane defined in said tooth along the central axis of said socket perpendicular to said first plane; and a ground engaging portion having one and only one substantially flat member spaced from said first plane and connected to and extending from one side portion of one of said first and second pairs of side portions generally perpendicular to said second plane and a single reinforcement rib centrally disposed along said second plane and being connected to both the flat member and the end portion a cross section of said tooth through said reinforcement rib and normal to said flat member being T-shaped.

7. The tooth, as set forth in claim 6, wherein the substantially flat member is closest to the first plane at the intersection between the flat member and the one side portion of the one of said pair of side portions.

8. The tooth, as set forth in claim 7, wherein the reinforcement rib is generally triangular in shape with the longest side extending from the other side portion of the one pair of side portions to the end of the flat member opposite the end that connects with said one side portion.

9. The tooth, as set forth in claim 6, wherein the substantially flat member is generally parallel with the first plane.

10. The tooth, as set forth in claim 6, wherein the side portions of said first pair of laterally spaced side portions are generally parallel and the side portions of said second pair of laterally spaced side portions are non-parallel and are closest together at their intersection with the end portion.

11. The tooth, as set forth in claim 10, including a hole defined in the first pair of laterally spaced side portions and opening into said socket.

12. The tooth, as set forth in claim 6, wherein the substantially flat member has a width at one end substantially equal to the width of the one side portion of the one pair of side portions at the point of intersection with the one side portion and a width at the other end less than one-third the width of the one side portion at said point of intersection.

13. The tooth, as set forth in claim 12, wherein the width of the flat member at its other end is no greater than the thickness of the reinforcement rib.

14. The tooth, as set forth in claim 6, including a bucket having a leading edge adapted for engagement with the ground, a sidewall member connected to one end of the leading edge, and a tooth adapter secured at one end to the leading edge adjacent the intersection of the sidewall member and connected at the other end with the attachment portion of said tooth.

15. The tooth, as set forth in claim 14, wherein said bucket further includes a second sidewall member connected to the other end of the leading edge, a second tooth adapter secured at one end to the other end of the leading edge adjacent the intersection of the second sidewall member and connected to the socket of a second tooth.

16. An earth working tooth adapted for attachment to either end of the leading edge of a bucket, comprising:

an attachment portion having first and second pairs of laterally spaced side portions connected by an end portion to define a socket, said socket being adapted for engagement with the bucket to maintain the tooth in a normal working position;

a first plane defined in said tooth along a central longitudinal axis of the socket, said plane being vertically oriented with respect to the normal working position of the tooth;

a ground engaging portion having one and only one substantially flat member spaced from said first plane and connected to and extending from one side portion of one of said pair of side portions and a single reinforcement rib extending perpendicularly from said flat member and being connected to both the flat member and the end portion; and a second plane defined in said tooth along the central axis perpendicular to said first plane, said tooth being symmetrical about said second plane, a cross section of said tooth through said reinforcement rib and normal to said flat member being T-shaped.

17. The tooth, as set forth in claim 16, wherein the reinforcement rib is generally triangular in shape with the longest side extending from the other side portion of the one side portion of the one pair of side portions to the end of the flat member opposite the end that connects with said one side portion.

* * * * *